US006751330B2

(12) United States Patent
Kowaki et al.

(10) Patent No.: US 6,751,330 B2
(45) Date of Patent: Jun. 15, 2004

(54) SPEAKER SYSTEM

(75) Inventors: Hiroshi Kowaki, Kobe (JP); Akira Nishikawa, Kobe (JP); Katsuhiko Tsumori, Kobe (JP); Hiroyuki Yoshii, Ikoma (JP)

(73) Assignees: Fujitsu Ten Limited, Hyogo (JP); Timedomain Corporation, Nara (JP)

( * ) Notice: Subject to any disclaimer, the term of this patent is extended or adjusted under 35 U.S.C. 154(b) by 23 days.

(21) Appl. No.: 09/771,946

(22) Filed: Jan. 29, 2001

(65) Prior Publication Data

US 2001/0028724 A1 Oct. 11, 2001

(30) Foreign Application Priority Data

Jan. 28, 2000 (JP) ..... 2000-024778
Nov. 10, 2000 (JP) ..... 2000-344333

(51) Int. Cl.[7] ..... H04R 1/02; H04R 7/00; A47B 81/06

(52) U.S. Cl. ..... 381/354; 381/386; 381/351; 381/346; 381/338; 381/337; 381/353; 381/430; 181/166; 181/199

(58) Field of Search ..... 381/349, 345, 381/346, 351, 353, 354, 386, 430, 338, 337; 181/161, 199

(56) References Cited

U.S. PATENT DOCUMENTS 4,152,552 A * 5/1979 Meyer ..... 381/340
4,620,317 A * 10/1986 Anderson ..... 381/412
4,665,550 A 5/1987 Haas
4,931,029 A * 6/1990 Hwang ..... 446/396
4,953,655 A * 9/1990 Furukawa ..... 381/340
5,333,204 A * 7/1994 Hamada et al. ..... 381/340
5,523,524 A * 6/1996 Prokish et al. ..... 181/159
5,771,302 A * 6/1998 Schindler ..... 381/159
5,889,877 A 3/1999 Bunzow

FOREIGN PATENT DOCUMENTS

| | | |
|---|---|---|
| CA | 2263177 | 2/1998 |
| JP | 5-153680 | 6/1993 |
| JP | 8-126087 | 5/1996 |
| JP | 8-251683 | 9/1996 |
| JP | 11-146471 | 5/1999 |
| JP | 11-289588 | 10/1999 |
| KR | 1987-3166 | 3/1987 |
| WO | WO 98/07294 | 2/1998 |

OTHER PUBLICATIONS

European Search Report for application No. 01300666.3–2411, dated Dec. 4, 2002.
Canadian Office Action for corresponding Canadian application No. 2,332,238, dated Mar. 28, 2003.

* cited by examiner

*Primary Examiner*—Rexford Barnie
(74) *Attorney, Agent, or Firm*—Christie, Parker & Hale, LLP

(57) ABSTRACT

A driver unit is fixed to a stand. A front box and a rear box are directly fitted to the stand through a buffer material. A box comes into contact with the driver unit through a buffer material and is fixed to the stand. Therefore, sound of the driver unit is not transmitted to the box and the drop of sound quality of the speaker can be prevented. The driver unit is fixed to the stand at an immovable foundation, and sound energy can be efficiently transmitted from a speaker cone to the air.

22 Claims, 13 Drawing Sheets

SPEAKER SYSTEM

CROSS-REFERENCE TO RELATED APPLICATION

This application claims priority of Japan patent Application No. 2000-24778, filed on Jan. 28, 2000 and Japan patent Application No. 2000-344333, filed on Nov. 10, 2000.

BACKGROUND OF THE INVENTION

1. Field of the Invention

This invention relates to a speaker system for use in an acoustic apparatus.

2. Description of the Related Art

Most conventional speaker systems employ the construction wherein a speaker driver unit (hereinafter called the "driver unit") is fixed by screws to the front of a speaker box (hereinafter called the "box").

In this conventional construction, vibration of the driver unit is likely to be transmitted to the box. Therefore, the box generates noise that is out of phase, and this noise is one of the factors that disturb the sound. According to the conventional construction, a yoke side of the driver unit is kept floating and is likely to vibrate. Consequently, when a cone for generating sound moves in the driver unit, the yoke side vibrates due to its reaction. This lowers energy transmission efficiency from the cone to air and deteriorates the transient characteristics of the sound.

Proposals are disclosed to solve these problems in Japanese Unexamined Patent Publication (Kokai) Nos. 11-146471, 5-153680, etc, but these apparatuses are not structurally strong and invite breakage of the products due to vibration during transportation.

SUMMARY OF THE INVENTION

It is therefore an object of the present invention to provide a speaker system having a construction in which vibration of a cone of a speaker is not easily transmitted to a box, energy transmission efficiency from the cone to air is high, and the product is highly resistant to breakage due to vibration during transportation.

To accomplish this object, the present invention provides a speaker unit comprising a speaker stand (hereinafter called the "stand"), a driver unit directly fixed to the stand, a box comprising a front box and a rear box, for accommodating therein the driver unit. The front box and the rear box are fixed to the stand by clamping the stand through a buffer material, and the box is directly fixed to the stand. A cushion, a gel, a spacer having a high vibration absorption coefficient, a felt, and so forth, can be used for the buffer material.

According to the present invention, the box is fitted to the stand through the buffer material, and the box and the driver unit are not mechanically coupled with each other. Therefore, the vibration of the cone of the speaker is not easily transmitted to the box, and the sound does not become turbid. Because the speaker can be fixed to the stand at an earth position, it can efficiently output sound energy. Because the box is directly fitted to the stand, the mechanical strength can be improved, and breakage during transportation can be reduced.

The front box and the rear box can be fixed to the stand by using a screw. In this case, it is possible to employ a screw-fixing structure from the front surface side of the front box or a screw-fixing structure from the rear surface side of the rear box, or from both front and rear surface sides. The box can be integrated by fixing one of the front and rear boxes to the stand, forming a screw at an engagement portion of the front and rear boxes, and mutually screw-fixing both boxes.

When a screw insertion hole is formed in the front box side, this hole may be utilized to fit a protective bar in order to protect the driver unit and to cover the screw insertion hole. A protective net may cover the front box to protect the driver unit and to cover the screw insertion hole.

In the present invention, the front box and the rear box can be fixed to the stand by means other than screw fixing.

In this case, a screw is threaded at a mutual joint portion of the front and rear boxes and one of the boxes is fixed to the stand by using this screw through the buffer material. The other box is fixed to the box so fitted, by using the screw described above.

In another embodiment of the present invention, the front box and the rear box include means for integrally coupling them, and may further have a construction wherein the front box and the rear box clamp the speaker stand through the buffer material, when they are integrated, by using the coupling means.

In the present invention, as explained above, the driver unit is directly fixed to the stand and can therefore efficiently output sound energy. In contrast, a weight may be fitted to the rear surface of the driver unit so that the driver unit can be fixed to an immovable foundation. In this case, even when the cone moves, the vibration of the driver unit can be suppressed. In consequence, sound energy can be outputted efficiently. In this embodiment, a sound absorption material preferably covers the periphery of the weight. Furthermore, when the stand is disposed at the center of gravity of the driver unit and the weight, the balance of the speaker system can be improved with an improvement in the mechanical strength.

The speaker system according to the present invention can be applied to a bass-reflex speaker. In this case, a sound absorbing material for absorbing unnecessary resonance sound is preferably arranged around the bass-reflex port. When the sound absorbing material is disposed inside the box, unnecessary resonance sound can be absorbed and tone quality can be improved. Since the bass-reflex port is utilized to fit the sound absorbing material, the fitting structure of the sound absorbing material can be simplified.

Incidentally, means for fixing the sound absorbing material to the bass-reflex port according to the present invention can be applied to speakers having an ordinary construction. For example, the present invention can obtain a similar effect when applied to the conventional speaker having a construction wherein the driver unit is fitted to the box.

BRIEF DESCRIPTION OF THE DRAWINGS

The above object and features of the present invention will be more apparent from the following description of the preferred embodiment with reference to the accompanying drawings, wherein:

FIGS. 1A and 1B shows a construction of a speaker system according to the present invention, wherein FIG. 1A is a sectional view of the speaker system when it is viewed from above, and FIG. 1B is a sectional view when it is viewed from a side;

FIGS. 3A, 3B and 3C show a construction of a front box shown in FIGS. 1A and 1B, wherein FIG. 3A is a front view, FIG. 3B is a side view and FIG. 3C is a rear view;

FIGS. 4A and 4B show a construction of the rear box shown in FIGS. 1A and 1B, wherein FIG. 4A is a front view and FIG. 4B is a side view;

FIGS. 9A, 9B and 9C shows an example where a protective bar is fitted to the speaker system according to the present invention, wherein FIG. 9A is a front view, FIG. 9B is a side view and FIG. 9C is a perspective view of the protective bar;

FIGS. 10A and 10B show the state where a protective net is fitted to the speaker system according to the present invention, wherein FIG. 10A shows the state where the protective net is fitted, and FIG. 10B shows the state where the protective net is being fitted;

DESCRIPTION OF THE PREFERRED EMBODIMENTS

Before describing the embodiments of the present invention, the related art and the disadvantage therein will be described with reference to the accompanying drawings.

Preferred embodiments of the present invention will now be explained with reference to the drawings.

Figure 1A:
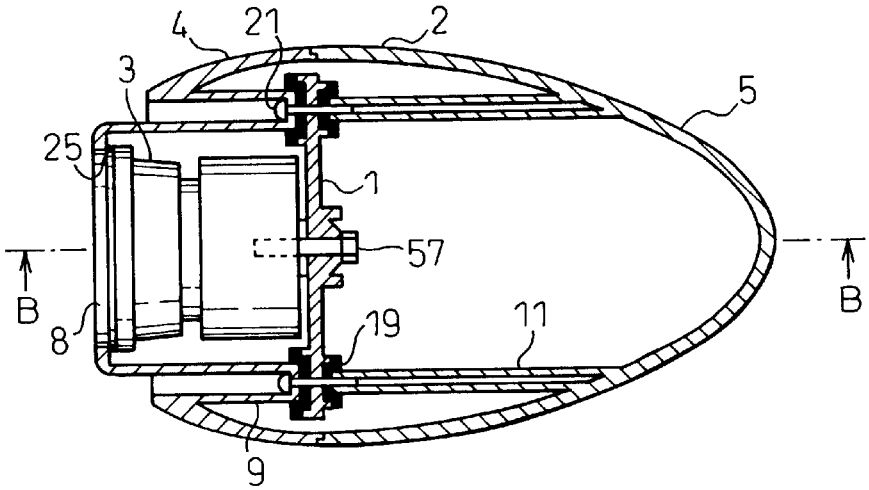
Figure 1B:
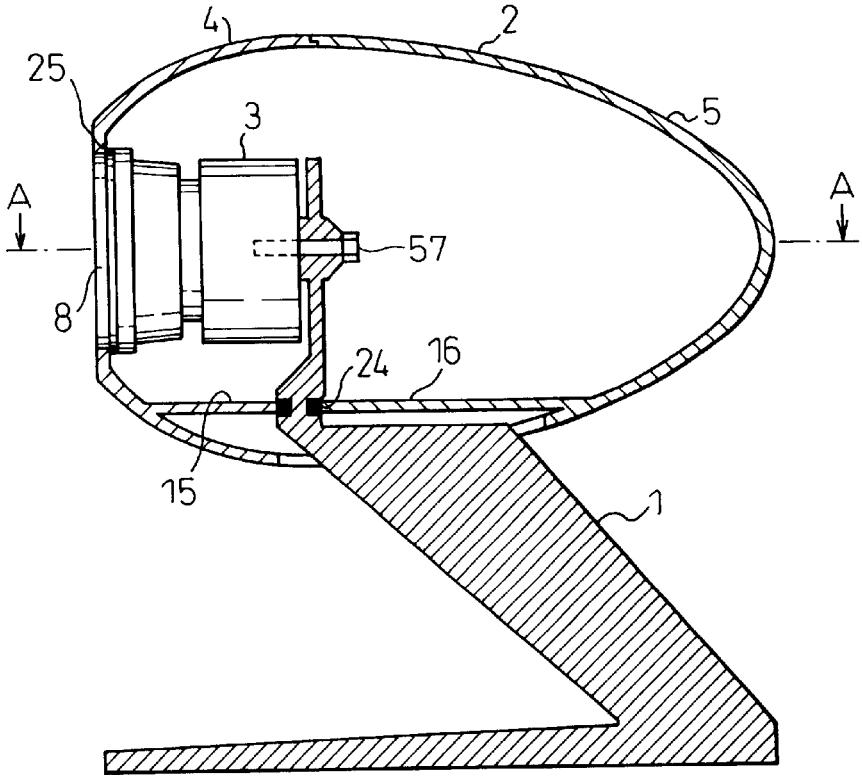

The construction of a speaker system will be explained with reference to FIG. 1. FIG. 1A is a sectional plan view of the speaker system taken along a line A—A in FIG. 1B, and FIG. 1B is a sectional side view taken along a line B—Bin FIG. 1A.

The speaker system includes a stand 1, a box 2 mounted onto the stand 1 and a driver unit 3 accommodated inside the box 2.

The box 2 comprises a front box 4 and a rear box 5, and has an elongated spherical shape in a longitudinal direction as a whole. The driver unit 3 is directly fixed to the stand 1. The front and rear boxes 4 and 5 are mounted to the stand 1 through a buffer material 19, respectively. The buffer material 19 can use a cushion formed of a foamed resin such as TEF, a gel, a spacer having a high vibration absorption coefficient such as a vibration-proofing rubber, or a felt.

An opening 8 is formed in the front surface of the front box 4. The front surface of the driver unit 3 is positioned there. The driver unit 3 and the opening 8 come into mutual contact through a cushion 25.

In the speaker system described above, the box 2 is fixed to the stand 1 through the buffer material 19. Since fixing can be conducted firmly, the box 2 is not broken during transportation. The box 2 and the driver unit 3 come into contact with each other through the cushion 25. Therefore, since the vibration of the driver unit 3 is not transmitted to the box 2, the box 2 does not generate noise having a deviated phase, and sound quality of the speaker system can be improved.

Because the driver unit 3 can be directly fixed to the stand 1, the speaker supporting position can be fixed to an immovable foundation. In consequence, when the cone emits the sound forward, the yoke side of the speaker does not move even when it receives the reaction of the movement of the cone, and sound energy can be efficiently emitted forward.

Hereinafter, a detailed construction of each component constituting the speaker system will be explained.

Figure 2:
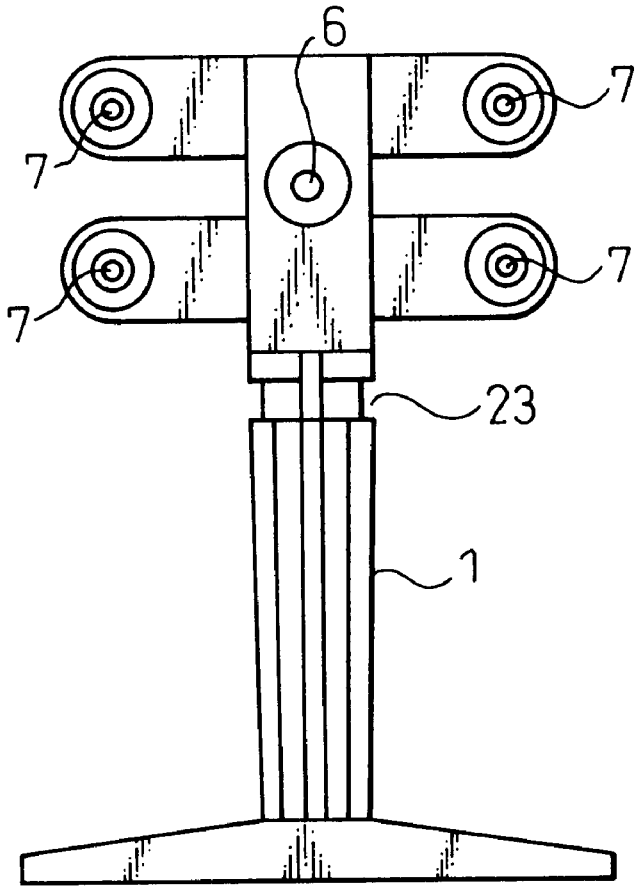
FIG. 2 is a front view of the stand shown in FIGS. 1A and 1B.

The construction of the stand 1 will be explained with reference to FIGS. 1A, 1B and 2. FIG. 2 shows the front shape of the stand 1. FIG. 1A shows the shape of the stand when it is viewed from the top and FIG. 1B shows the shape when viewed from the side.

The stand 1 has a shape such that its bottom surface can be put on the floor and its upper part can be fitted to the driver unit 3 and to the box 2. Incidentally, the stand 1 is not particularly limited to the floor placement type, and the term "stand" used in this specification includes a pendant type (in which the bottom surface of the stand is fixed to a ceiling, a wall, etc, by screws, or has a grip structure to grip a pole, etc, for fixing), and so forth.

A hole 6 is formed at the center of the upper part of the stand 1. A screw 57 is fitted into the hole 6 from the rear surface side and fixes the driver unit 3 disposed on the front surface of the stand 1. Four holes 7 are formed around the hole 6 of the stand 1. The box 2 is fitted to the stand 1 by using these holes 7. A ring-like recess 23 is formed at an intermediate part of the stand 1. A ring-like cushion 24 is fitted into this recess 23 so as to keep the box 2 and the stand 1 airtight. This construction will be described later in further detail.

Figure 3A:
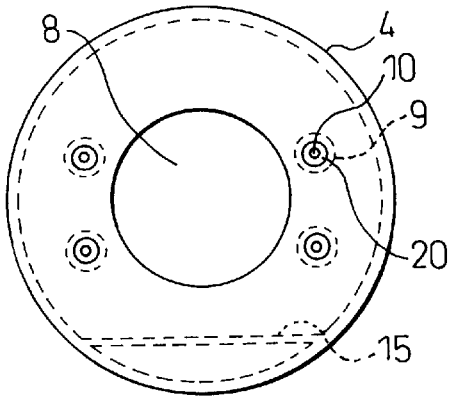
Figure 3B:
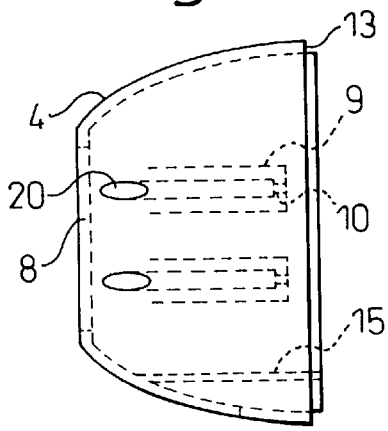
Figure 3C:
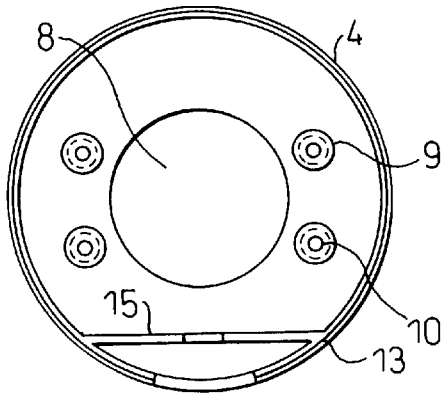

The construction of the front box 4 will be explained with reference to FIGS. 3A to 3C. FIG. 3A is a front view, FIG. 3B is a side view and FIG. 3C is a rear view.

An opening 8 is defined at the center of the front surface of the front box 4. Cylindrical members 9 extending rearward are formed at four positions round the opening 8 that correspond to the holes 7 of the stand 1. Each cylindrical member 9 has therein a hole 20 into which a screw is fitted. The screw-fitting hole 20 is exposed to the surface side of the box. A hole 10 is formed at the inner distal end portion of each cylindrical member 9.

A step portion 13 is formed at the rear part of the front box 4. The step portion 13 engages with a later-appearing step portion 14 that is formed on the rear box 5. An airtight plate 15 extending in a horizontal direction is formed at a lower part of the front box 4. This airtight plate 15 will be further described later.

Figure 4A:
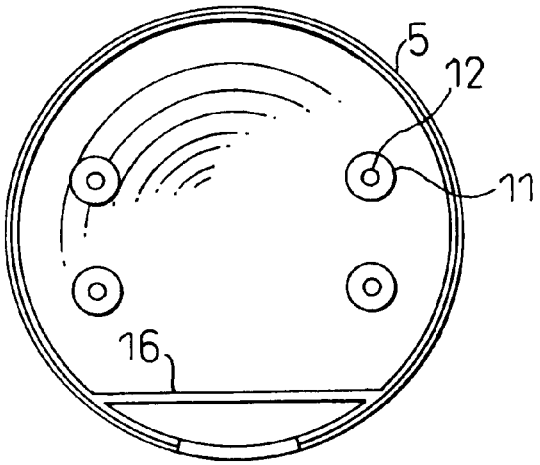
Figure 4B:
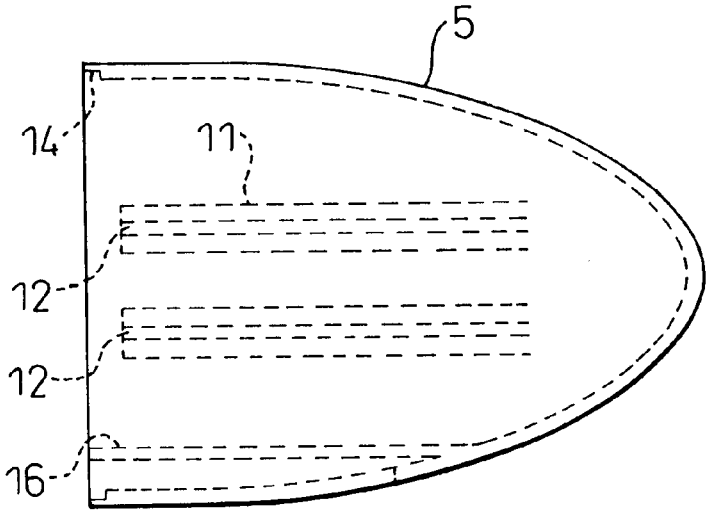

The construction of the rear box 5 will be explained with reference to FIGS. 4A and 4B. FIG. 4A is a front view and FIG. 4B is a side view.

Cylindrical members 11 extending forward are formed in the rear box 5 at positions corresponding to the holes 7 formed in the stand 1. A female screw is threaded in a hole 12 formed in each cylindrical member 11. The hole 12 is closed at its rear part and is not exposed on the front surface side of the rear box 5.

A step portion 14 is formed in the periphery of the front part of the rear box 5. The step portion 14 engages with the step portion 13 formed on the front box 4. An airtight plate 16 extending in the horizontal direction is formed at a lower part of the rear box 5. This airtight plate 16 will be further described later.

Figure 5:
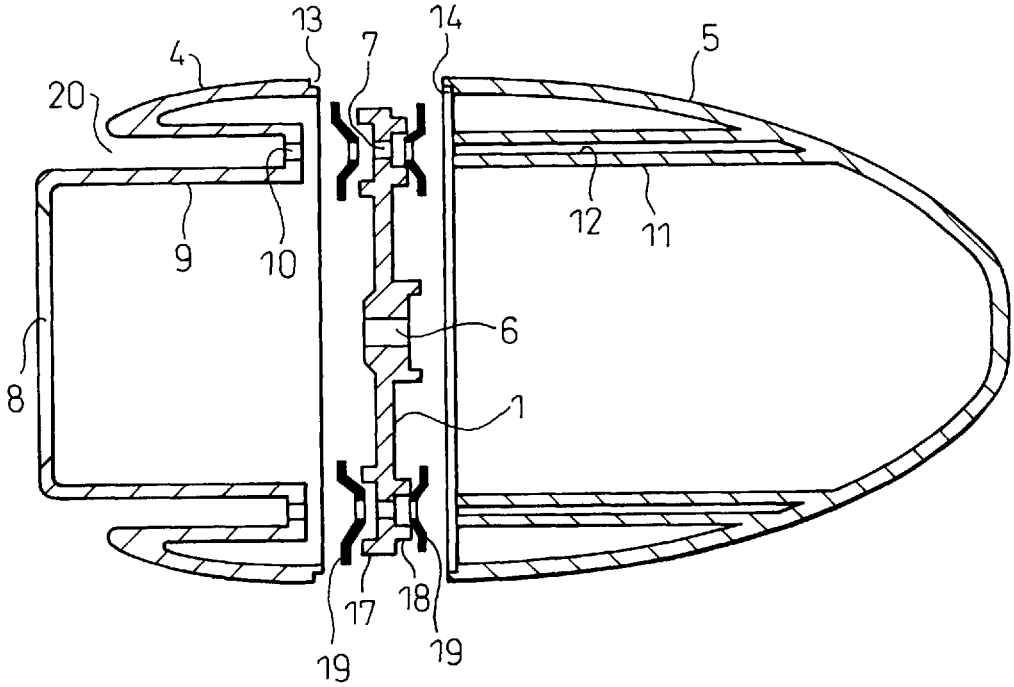
FIG. 5 shows a fitting method of the stand, the front box and the rear box shown in FIGS. 1A to 4B.

FIG. 5 shows a fitting method of the stand 1, the front box 4 and the rear box 5.

The step portions 13 and 14 formed in the periphery of the engagement portion between the front box 4 and the rear box 5 engage with each other and keep the inside of the box 2 so integrated airtight.

Ring-like protuberances 17 and 18 are formed round the four holes 4 of the stand 1. The distal end of the cylindrical member 9 of the front box 4 is fitted to the front protuberance 17 through a buffer material 19. The distal end of the cylindrical member 11 of the rear box 5 is fitted to the rear protuberance 18 through the buffer material 19. In other words, the stand 1 side has a female structure and the front-and-rear box 5 side has a male structure.

Figure 6:
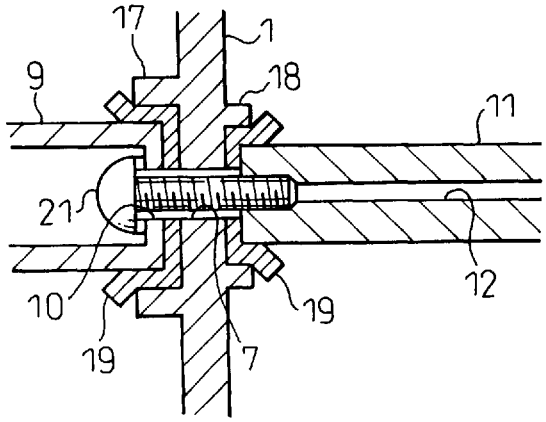
FIG. 6 is an enlarged view of a fixed portion shown in FIG. 5.

FIG. 6 is an enlarged view of the fixing portion shown in FIG. 5.

A screw 21 is inserted from a hole 20 on the front surface side of the front box 4. This screw 21 is fixed to a female screw formed in the hole 12 of the cylindrical member 11 of the rear box 5 while penetrating through the hole 10 of the cylindrical member 9, the buffer material 19, the hole 7 of the stand 1 and the buffer material 19.

When the screw 21 is fastened, the step portions 13 and 14 of the front and rear boxes 4 and 5 are coupled, forming the integrated box 2 as shown in FIGS. 1A and 1B. Since the front box 4 is urged towards the driver unit 3 in this case, the ring-like cushion 25 is compressed, keeping the inside of the box 2 airtight at the opening 8.

Figure 7:
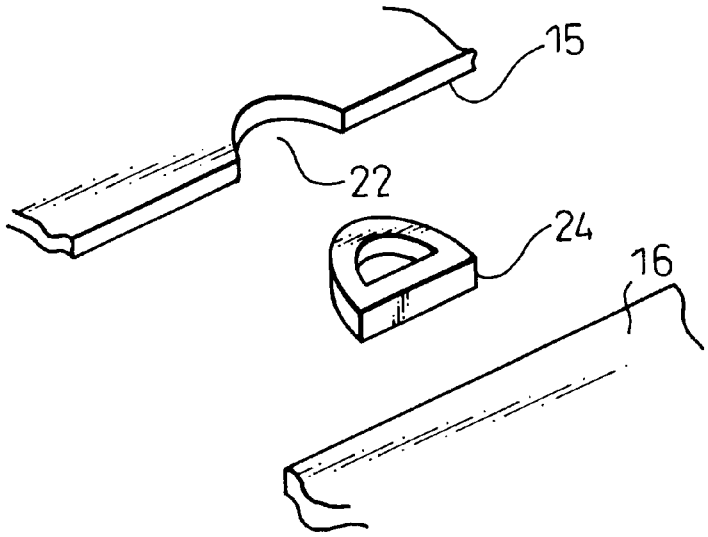
FIG. 7 shows a construction of a portion at which the stand shown in FIG. 1 penetrates through the box.

The construction of the portion at which the stand 1 penetrates through the lower part of the box 2 will be explained with reference to FIG. 7.

The ring-like recess 23 is formed in the stand 1 (see FIG. 2). The cushion 24 shown in FIG. 7 is fitted into this recess 23 (see FIG. 1B). A semi-circular notch 22 is formed in the airtight plate 15 of the front box 4. When the screw 21 fixes the speaker system, the end portions of the airtight plates 15 and 16 of the front and rear boxes 4 and 5 are butted against each other. The stand 1 penetrates through the notch 22 through the cushion 24.

In the box 2, the opening 8 is kept airtight by the cushion 25 and the penetration portion of the stand 1 is kept airtight by the cushion 24. The joint portion between the front box 4 and the rear box 5 is kept airtight as the step portions 13 and 14 engage with each other.

Though one embodiment of the present invention has thus been described, the present invention can be changed or modified in various ways.

Figure 8:
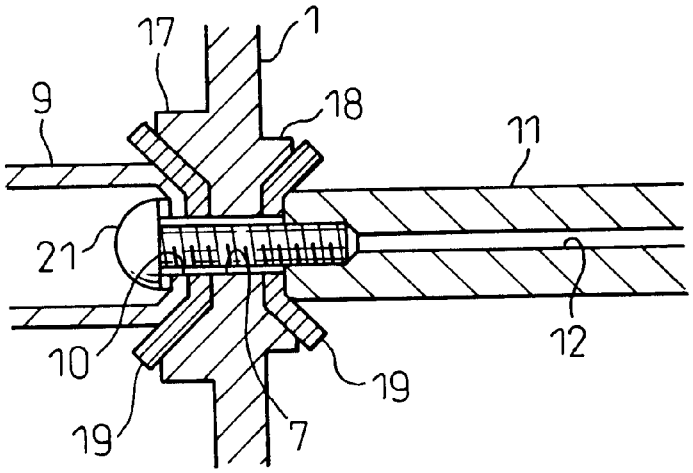
FIG. 8 shows a modified example of the fixed portion shown in FIG. 6.

FIG. 8 shows a modified example of the fitting structure shown in FIG. 6.

In the example shown in FIG. 6, the distal ends of the cylindrical members 9 and 11 and the receiving side of the stand 1 have the cylindrical male-female structure. In this example, the distal ends of the cylindrical members 9 and 11 and the receiving side of the stand 1 have a conical shape. According to this construction, the conical portion guides the cylindrical members 9 and 11 into the protuberances 17 and 18. In consequence, positioning can be made easily.

Figure 9C:
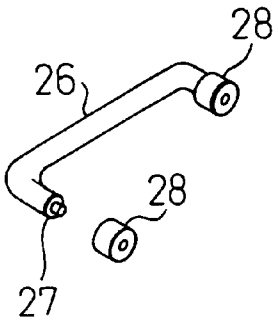
Figure 9B:
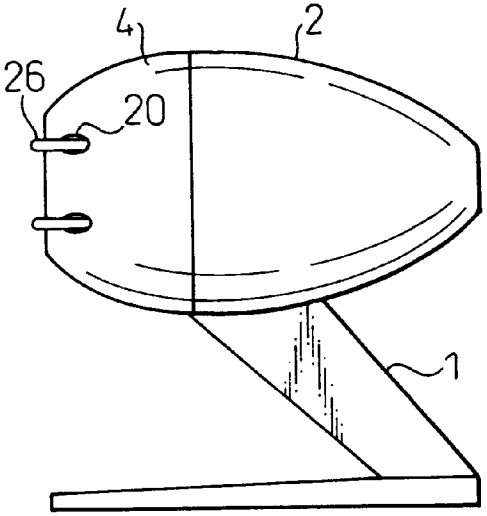
Figure 9A:
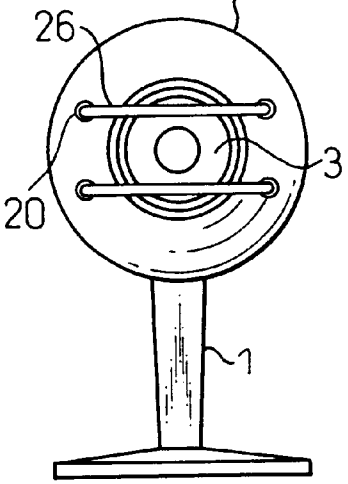

FIGS. 9A to 9C show an example where a protective bar for protecting the driver unit 3 is fitted to the front surface side of the speaker system. FIG. 9A is a front view, FIG. 9B is a side view and FIG. 9C is a perspective view of the protective bar.

In the speaker system according to the present invention, the hole 20 for inserting the screw 21 is exposed on the front surface side of the front box 4. To conceal this hole 20 and to protect the cone of the driver unit 3 exposed by the opening 8, the protective bar 26 is fitted in this example.

The protective bar 26 is produced by bending a metal bar. A rubber ring 28 is fitted to a step portion 27 formed at each end of the bar. When both ends of the protective bar 26 are fitted into the screw insertion holes 20, they are held in the screw insertion holes 20 by the flexibility of the rubber rings 28. This example can improve the design of the speaker system, too.

Figure 10A:
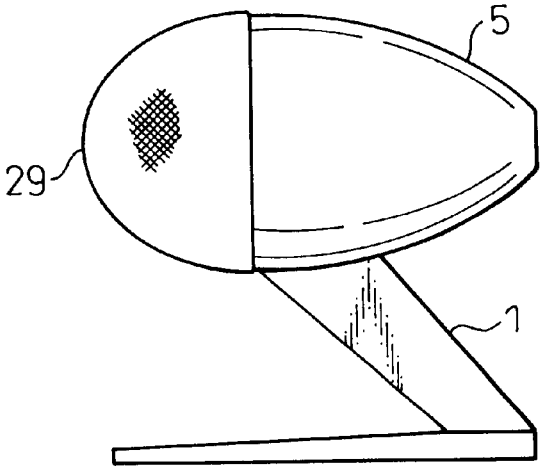
Figure 10B:
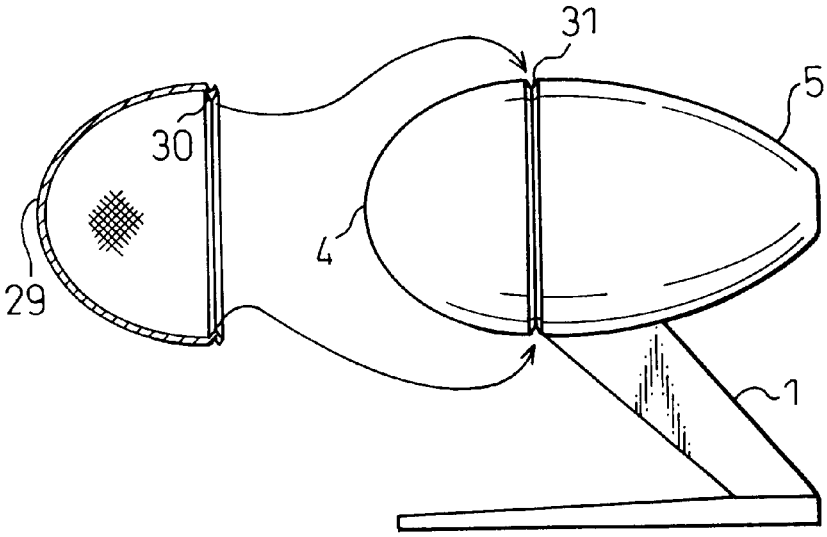

FIGS. 10A to 10C show an example where a protective net is used for protecting the driver unit on the front surface side of the speaker system. FIG. 10A is a side view showing the state where the protective net is fitted to the front surface of the speaker system. FIG. 10B is a side view useful for explaining the protective net, wherein the protective net is shown in section.

The protective net 29 is formed of a plastic material or a metal into a semi-spherical shape, and has a large number of holes. Protuberances extending inward are formed into a ring-like shape round the peripheral edge portion of the protective net 29. On the other hand, a step portion 31 is formed at an engagement portion between the front box 4 and the rear box 5. To fit the protective net 29, the protective net 29 is fitted from the front surface side as shown in FIG. 10B. The protuberances 30 move over the surface of the front box 4 due to their flexibility and finally engage with the step portion 3 to be held by the latter.

Incidentally, the step portion 31 may be formed on the front box 4 or the rear box 5 or at an intermediate portion. This example, too, can improve the design of the speaker system.

Next, a modified example of the fixing method of the front box 4, the rear box 5 and the stand 1 will be explained. Incidentally, the protuberances 17 and 18 and the buffer material 19 shown in FIGS. 6 and 8 are omitted in the following drawings in order to make the illustration more easily understood.

Figure 11:
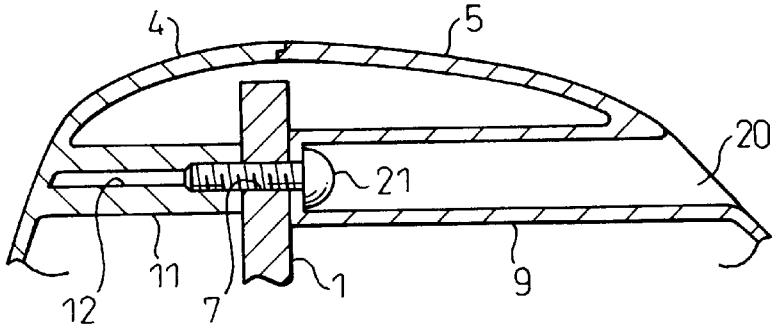
FIGS. 11, 12, 13, 14, 15, 16 and 17 respectively show modified examples of the fixing method of the speaker box and the stand in the speaker system according to the present invention.

FIG. 11 shows an example where the fixing screw 21 is inserted from the rear box (5) side.

In this example, the cylindrical member 9 having the screw-inserting hole 20 is provided to the rear box 5, and the cylindrical member 11 having the female screw 12 is provided to the front box 4. The screw 21 is inserted into the hole 20 from the surface side of the rear box 5 at the time of fixing, and the front box 4 and the rear box 5 are fixed as a whole. Incidentally, holes may be formed in the surface of the front box 4 so as to fit the protective bar 26.

Figure 12:
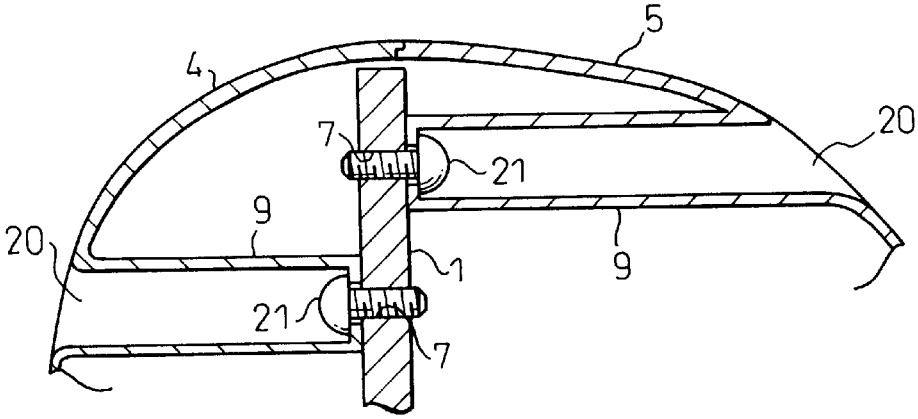

FIG. 12 shows an example where screw fitting is made from both the front and the rear sides of the speaker system.

In this example, female screws are threaded in the holes 7 formed in the stand 1. Four cylindrical members 9 each having a screw-insertion hole 20 are provided to each of the front and rear boxes 4 and 5 in such a manner as to oppose the respective holes 7. Therefore, eight holes 7 must be formed in the stand 1.

When each screw 21 is inserted from the hole 20 of the front box 4 and is screwed to the female screw hole 7, the front box 4 is individually fixed to the stand 1. The rear box 5, too, is fixed similarly to the stand 1.

Figure 13:
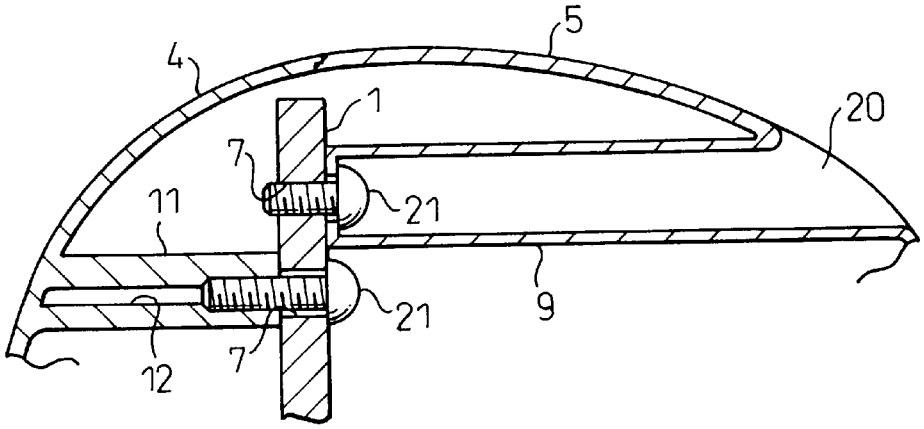

FIG. 13 shows a modified example where fixing by screws is made from the rear part of the speaker system.

The cylindrical member 11 having the hole 12 for forming the female screw is provided to the front box 4. The hole 7 of the stand 1 opposing this hole 12 is not threaded. The cylindrical member 9 having the screw-insertion hole 20 is provided to the rear box 5. A female screw is threaded in the hole 7 of the stand opposing the hole 20.

First, the cylindrical member 11 of the front box 4 is put to the stand 1 from the front side, and is fastened by the screw 21 from the back. Next, the cylindrical member 9 of the rear box 5 is put to the stand 1 from the back, and after the screw 21 is inserted into the hole 20, the cylindrical member 9 is fastened from the back.

Incidentally, it is also possible to employ the construction wherein the cylindrical member 9 having the screw-insertion hole 20 is formed in the front box 4 and the cylindrical member 11 having the female screw stand 12 in the rear box 5 on the contrary to the example shown in FIG. 13, the rear box 5 is first fixed to the stand 1 and the front box 4 is then fixed.

Figure 14:
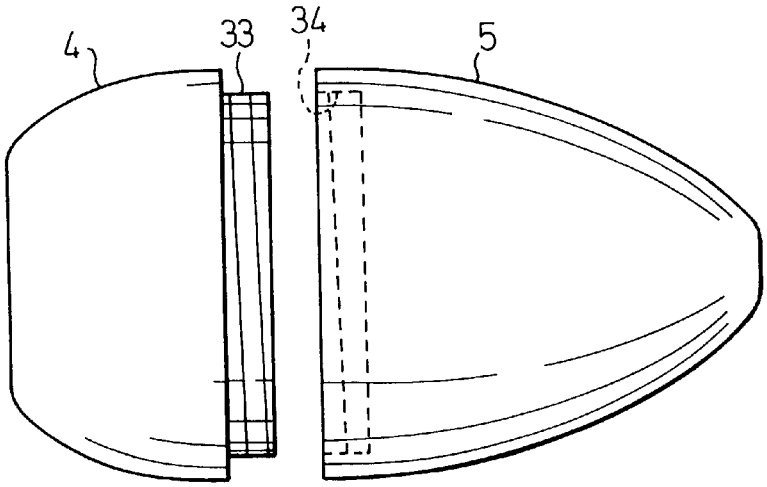

FIG. 14 shows an example where the rear box 5 is screwed into, and fixed to, the front box 4.

A male screw 33 and a female screw 34 are formed at the joint portion of the front box 4 and the rear box 5. After the front box 4 is fixed to the stand 1 by any of the methods described above, the female screw 34 of the rear box 5 is meshed with the male screw 33 of the front box 4 to integrate both boxes 4 and 5 with each other. In a modified example, it is possible to first fix the rear box 5 to the stand 1 and then to fit the rear box 4 by screwing.

Figure 15:
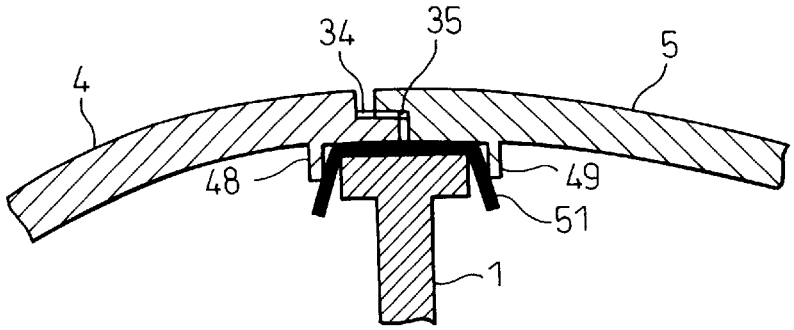

In the example shown in FIG. 15, a male screw 34 and a female screw 35 are formed at the joint portion of the front box 4 and the rear box 5 in the same way as in the example shown in FIG. 14, and ribs 48 and 49 are formed in the peripheral direction inside both boxes 4 and 5. The stand 1 is formed into the shape such that its outer periphery keeps contact with the inside of both boxes 4 and 5.

When the front box 4 and the rear box 5 are fixed to the stand 1, a buffer material 51 is disposed round the stand 1. The front box 4 is fitted from the front and the rear box 5, from the back. As the rear box 5 is rotated, the male screw 34 and the female screw 35 mesh with each other, integrating both boxes 4 and 5 with each other. In this instance, the distance between the two ribs 48 and 49 becomes shorter, and the ribs 48 and 49 fasten the stand 1 through the buffer material 51. In consequence, the front box 4 and the rear box 5 are fixed to the stand 1.

Figure 16:
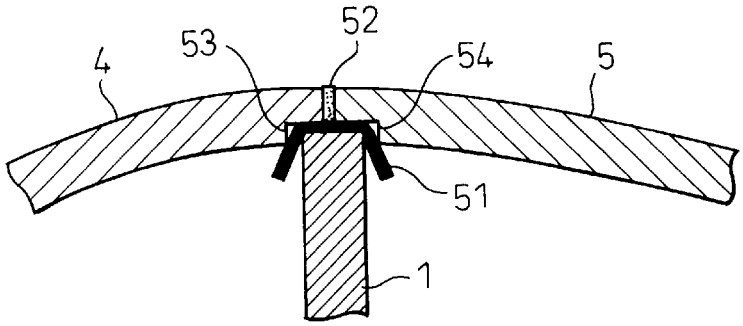

In the example shown in FIG. 16, an adhesive 52 is used to fix the front box 4 and the rear box 5. Step portions 53 and 54 are formed inside the end portions of the front and rear boxes 4 and 5 in place of the ribs.

To fix the front box 4 and the rear box 5 to the stand 1, the adhesive 52 is applied to the end faces of the joint portion of both boxes 4 and 5. After the buffer material 51 is disposed round the stand 1, the step portions 53 and 54 are so arranged as to engage with the periphery of the stand 1, and the end portions of both boxes 4 and 5 are brought into mutual contact. After the adhesive 52 is set, the front box 4 and the rear box 5 are fixed to the stand 1. Incidentally, the front box 4 and the rear box 5 may be fixed by fusing.

Figure 17:
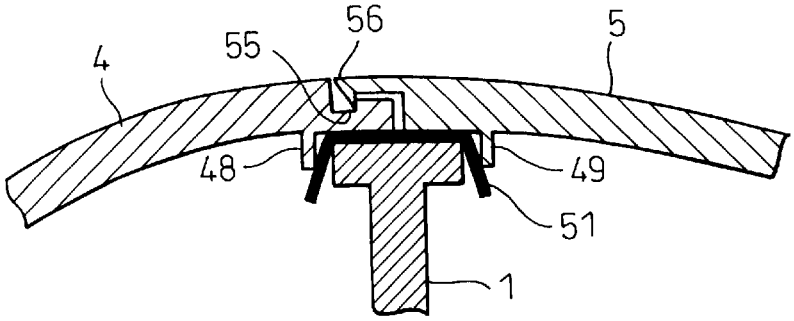

In the example shown in FIG. 17, the front box 4 and the rear box 5 are fixed through pawl engagement.

A groove 55 is formed in the peripheral direction at the joint portion of the front box 4. A pawl 56 is formed in the peripheral direction at the joint portion of the rear box 5. To fix the front and rear boxes 4 and 5 to the stand 1, the rear box 5 is pushed to the front box 4 so that the pawl 56 can be fitted into the groove 55, thereby fixing the front and rear boxes 4 and 5 to the stand 1.

Figure 18:
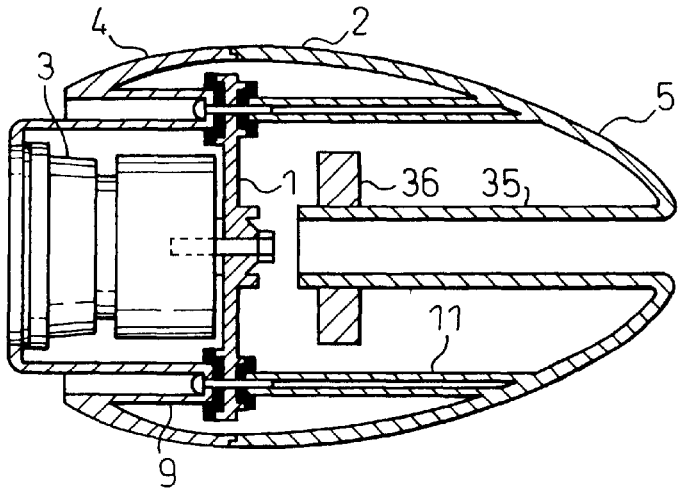
FIG. 18 shows an example where the speaker system according to the present invention is applied to a bass-reflex speaker.

FIG. 18 shows an example where the speaker system according to the present invention is applied to a bass-reflex speaker.

A cylindrical bass-reflex port 35 protruding from the back into the box 2 is formed in the rear box 5. An adhesive is applied to fix a ring-shaped sound absorbing material 36, formed of a glass wool, to the bass-reflex port 35. The shape of the sound absorbing material 36 and its fixing method are not particularly limited to those shown in the drawing, but may be arbitrary.

The sound absorbing material 36 is disposed near the center of the box 2. Displacement of the vibration of air inside the box 2 reaches maximum at the center portion. Since the sound absorbing material 36 is disposed at the center, it can efficiently absorb unnecessary resonance sound inside the box 2, and can improve sound quality. Because the bass-reflex port 35 is used to fit the sound absorbing material 36, an extra fitting member is not necessary.

Figure 19:
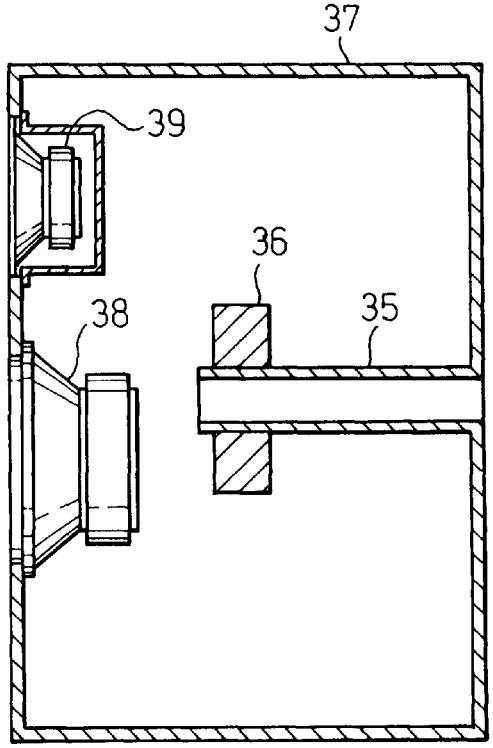
FIG. 19 shows an example where a bass-reflex enclosure of the present invention is applied to a speaker system having an ordinary construction.

The construction shown in FIG. 18 can provide a predetermined effect when it is applied to speaker systems having an ordinary construction, too. FIG. 19 shows an example where it is applied to a speaker system of the type in which the driver unit is directly fixed to the box.

A middle and low frequency range driver unit 38 and a high and middle frequency range driver unit 39 are disposed on the front surface of a rectangular parallelepiped box 37. The cylindrical bass-reflect port 35 is disposed in such a manner as to extend from the rear surface side to the inside. The ring-like sound absorbing material 36 is disposed at the center of the box 37 by utilizing the bass-reflex port 35. This example, too, can provide an effect similar to that of the speaker system shown in FIG. 18.

Figure 20:
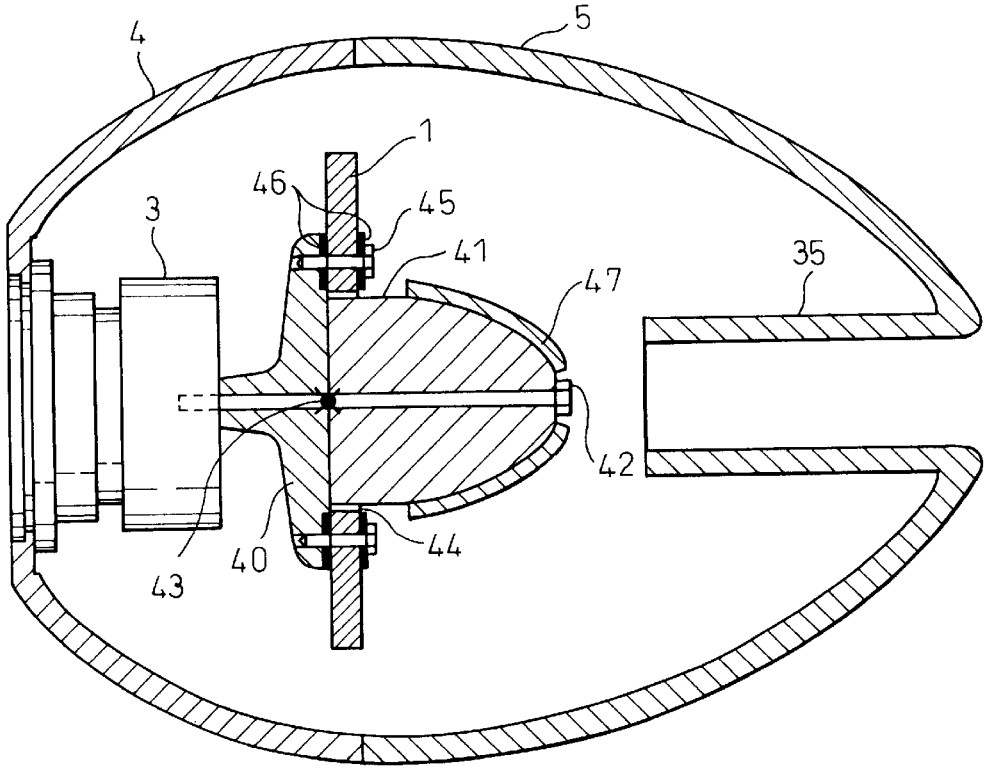
FIG. 20 shows an example where a weight is arranged in a driver unit of the speaker system according to the present invention.

FIG. 20 shows an example where a weight is provided to the driver unit 3.

The weight 41 is fixed to the rear surface of the driver unit 3 by a screw 42 through an adaptor 40. An opening 44 is formed in the stand 1. After the driver unit 3, the adaptor 40 and the weight 41 are passed through the opening 44, they are fixed by using a screw 45 to the stand 1. The driver unit 3, the adaptor 40 and the weight 41 are preferably fixed at the center of gravity 43 of the stand 1.

At this time, the buffer material 46 is interposed into the gaps of the screw 45, the stand 1 and the adaptor 40 in the same way as in the foregoing embodiments. The sound absorbing material 47 covers the periphery of the weight 41.

According to this example, the vibration of the driver unit 3 is transmitted to the weight 41, and the weight 41 operates as an immovable foundation. Since the buffer material 46 is interposed between the driver unit 3 and the stand 1, the vibration of the driver unit 3 is transmitted to only the weight 4. Consequently, the driver unit 3 is fixed to the virtual ground (weight 41). As a result, the driver unit 3 can efficiently output sound energy and the stand 1 need not be fixed.

According to the present invention, the vibration of the speaker is prevented from being easily transmitted to the box. Therefore, the present invention can provide a speaker system that has a high-energy transmission efficiency and is highly resistant to breakage due to impact during transportation.

What is claimed is:

1. A speaker system comprising:

a speaker stand;

a speaker driver unit directly fixed to said speaker stand;

a speaker box comprising a front speaker box and a rear speaker box, for accommodating therein said speaker driver unit; and fixing means for fixing said front speaker box and said rear speaker box to said speaker stand through a buffer material.

2. A speaker system according to claim 1, wherein said fixing means fixes said front speaker box and said rear speaker box, by a screw, to said speaker stand.

3. A speaker system according to claim 2, wherein a hole for inserting said screw is formed in a front surface of said front speaker box.

4. A speaker system according to claim 2, wherein a hole for inserting said screw is formed in a rear surface of said rear speaker box.

5. A speaker system according to claim 2, wherein a hole for inserting said screw is formed in a front surface of said front speaker box and in a rear surface of said rear speaker box.

6. A speaker system according to claim 1, wherein said fixing means fixes a part of each of said front and rear speaker boxes by a screw to said speaker stand, a screwing part is formed at a mutual joint portion of said front and rear speaker boxes, and said screwing part fixes said front and rear speaker boxes to each other.

7. A speaker system according to claim 6, wherein a recess is formed in said speaker stand at a portion at which said speaker box is fixed to said stand, a protuberance is formed in said speaker box, and said buffer material is interposed between said protuberance and said recess.

8. A speaker system according to claim 1, wherein said fixing means includes means for integrally coupling said front speaker box and said rear speaker box, and an engagement portion formed on each of said front and rear speaker boxes and clamping said speaker stand through said buffer material when both of said speaker boxes are integrated with each other.

9. A speaker system according to claim 1, which further comprises a weight fitted to a rear surface of said speaker driver unit.

10. A speaker system according to claim 9, wherein said speaker driver unit and said weight are fixed to said speaker stand through a butter material.

11. A speaker system according to claim 9, wherein said speaker driver unit and said weight are fixed to said speaker stand at their center of gravity.

12. A speaker system according to claim 9, wherein a sound absorbing material covers a periphery of said weight.

13. A speaker system according to claim 1, wherein said buffer material is a cushion.

14. A speaker system according to claim 1, wherein said buffer material is a gel.

15. A speaker system according to claim 1, wherein said buffer material is a spacer having a high vibration absorption coefficient.

16. A speaker system according to claim 1, wherein said buffer material is a felt.

17. A speaker system according to claim 2, wherein when a hole for inserting said screw is formed in a front surface of said front speaker box, a protective bar of said speaker driver unit is held by said hole.

18. A speaker system according to claim 1, wherein a protective net of said speaker driver unit is fitted to cover said front speaker box.

19. A speaker system according to claim 1, which further comprises a bass-reflecting port and a sound absorbing material fitted to a periphery of said bass-reflecting port.

20. A speaker system according to claim 1, comprising:

a bass-reflecting port disposed inside said speaker box; and a sound absorbing material fixed to the periphery of said bass-reflecting port.

21. A speaker system comprising:

a speaker stand;

a speaker driver unit directly fixed to said speaker stand;

a speaker box comprising a front speaker box and a rear speaker box, and said speaker driver unit therein; and a buffer material, said front speaker box and said rear speaker box being fixed to said speaker stand through said buffer material.

22. A speaker system comprising;

a speaker box comprising a front speaker box and a rear speaker box;

a speaker stand adapted to support said speaker box on a surface or fix said speaker box to a surface;

a speaker driver unit directly fixed to said speaker stand, and positioned within said speaker box; and a buffer material, said front speaker box and said rear speaker box being fixed to said speaker stand through said buffer material.

* * * * *